US006295854B1

(12) United States Patent
Stein et al.

(10) Patent No.: US 6,295,854 B1
(45) Date of Patent: Oct. 2, 2001

(54) DEVICE AND METHOD FOR MOULDING A GROOVED STRUCTURE INTO A TUBULAR WORKPIECE

(75) Inventors: Bernd Stein, Bonn; Karl-Heinz Putz, Cologne; Heinz Steinhauer, Troisdorf; Wilhelm Zimmermann, St. Augustin, all of (DE)

(73) Assignee: Dynamit Nobel GmbH Explosivstoff-und Systemtechnik, Troisdorf (DE)

( * ) Notice: Subject to any disclaimer, the term of this patent is extended or adjusted under 35 U.S.C. 154(b) by 0 days.

(21) Appl. No.: 09/463,011

(22) PCT Filed: Jul. 4, 1998

(86) PCT No.: PCT/EP98/04148

§ 371 Date: Apr. 19, 2000

§ 102(e) Date: Apr. 19, 2000

(87) PCT Pub. No.: WO99/03618

PCT Pub. Date: Jan. 28, 1999

(30) Foreign Application Priority Data

Jul. 19, 1997 (DE) ..... 197 31 055

(51) Int. Cl.[7] ..... B21B 19/08

(52) U.S. Cl. ..... 72/96; 72/83; 72/85

(58) Field of Search ..... 72/77, 78, 85, 72/91, 96, 83, 98

(56) References Cited

U.S. PATENT DOCUMENTS

| | | | | |
|---|---|---|---|---|
| 3,149,512 | * | 9/1964 | Leinbach | 72/96 |
| 5,115,656 | * | 5/1992 | Kummerling et al. | 72/96 |
| 5,428,980 | * | 7/1995 | Iidaka | 72/85 |

FOREIGN PATENT DOCUMENTS

| | | | | |
|---|---|---|---|---|
| 61-27109 | * | 2/1986 | (JP) | 72/85 |
| 893361 | * | 12/1981 | (SU) | 72/85 |
| 1294444 | * | 3/1987 | (SU) | 72/85 |

* cited by examiner

*Primary Examiner*—Ed Tolan
(74) *Attorney, Agent, or Firm*—Antonelli, Terry, Stout & Kraus, LLP

(57) ABSTRACT

According to the invention, a press roller device (1) for molding a grooved structure inside a tubular workpiece (7) has several press rollers (4,5,6), said press rollers rotating around a form tool (2) and being staggered axially in relation to one another. At least two of the press rollers (4,5) are driven in opposite directions to each other. This arrangement prevents the workpiece from twisting to a large extent.

8 Claims, 2 Drawing Sheets

DEVICE AND METHOD FOR MOULDING A GROOVED STRUCTURE INTO A TUBULAR WORKPIECE

The invention relates to a pressing roller device and a method for moulding a grooved structure, for example a thread or a toothing, into the inner surface of a tubular workpiece.

Devices are known for the manufacture of pipes with internal toothing or internal threads, which have a round shaping tool with an external toothing, on to which a tubular workpiece is pushed. Pressure is exerted on to the attached pipe from the outside with a pressing tool, with the result that an internal thread corresponding to the shaping tool is formed in its interior. The pressing tool is moved in the longitudinal direction of the pipe with an advancing movement, with the result that the same pressure is exerted on to each point of the outer surface.

In the so-called cylindrical pressing methods, smooth cylindrical pipes of relatively small wall thickness are made from a relatively short workpiece with a thick wall thickness. In this procedure the workpiece is subjected to a rotating extrusion moulding procedure. The workpiece is attached to a cylindrical shaping tool provided with a thread or a toothing, while, on the outside, several press rollers rotate about the shaping tool and the workpiece and in this way press the workpiece into the contouring of the shaping tool and in the process extend it with an advancing movement. An extrusion-deformation of the metal takes place between the shaping tool and the press rollers, with the original wall thickness of the workpiece decreasing and the length increasing as a result.

In DE-OS 24 20 014 a so-called flow turning process is described. A workpiece located on a tool mandrel is pressed by at least three pressing rollers rotating about the workpiece and subject to an axial advancing movement, against the shaping tool which has an external thread or a toothing, with the result that an internal thread or a toothing is formed in the workpiece. The driven pressing rollers are located in a radial plane of the shaping tool, i.e. the three identical pressing rollers engage the same circumferential region of the workpiece. Because the shaping tool is rotated relative to the pressing rollers, a relatively large torsional force acts on the workpiece, this force leading to a twisting of the workpiece during the plastic deformation by way of the pressing rollers. The torsion of the workpiece leads to a strain on the shaping structure of the tool, with the result that the service life of the shaping tool is considerably reduced. Shearing of the shaped structure can even possibly result.

The object of the invention is to improve the manufacture of tubular workpieces with an inner grooved structure to the extent that the torsion of the workpiece and therefore the strain on the shaping tool is considerably reduced.

In tests it has been found that the torsion of the workpiece can be almost completely prevented if the entry angle of the pressing roller which has engaged last is greater than the entry angle of the forward pressing rollers.

The entry angle of the last pressing roller is preferably at least 30°, the entry angle being, in particular, approximately 50% larger than that of the first pressing roller.

Further advantages developments of the invention will be explained in more detail in connection with the drawings.

Figure 1:
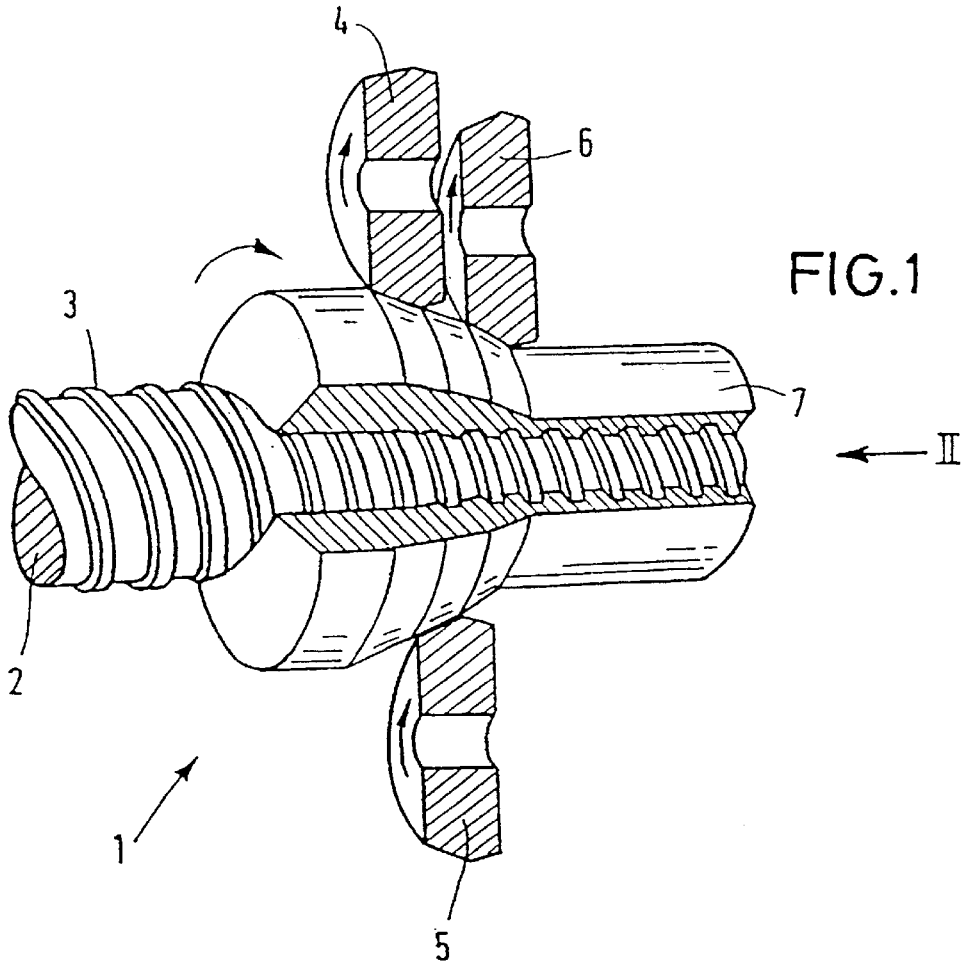
FIG. 1 shows a perspective view of a pressing roller device.

The pressing roller device 1 shown in FIG. 1 has a cylindrical shaping tool 2, to the outer surface of which a helical grooved formation 3 is applied. The shaping tool 2 is formed of hardened steel or hard metal. Three pressing rollers 4, 5, 6 rotate about the shaping tool 2. The pressing rollers 4, 5, 6 are spaced slightly axially apart from each other, with the result that the first pressing roller 4 in the advancing direction is the first one to meet a workpiece 7 located on the shaping tool 2. The pressing rollers 4, 5, 6 each have a spacing of about 0.1 to 5 mm, this being small in contrast to a roller width of, for example, 70 to 80 mm. In this respect, offset does not mean that the rollers have a spacing between them, but that, for example, the respective points of contact of the pressing rollers 4, 5, 6 are staggered by 0.1 to 5 mm, i.e. that the circular paths of the pressing rollers 4, 5, 6 overlap.

The workpiece 7 is hollow-cylindrical in the non-machined starting state and is attached to the end of the shaping tool 2, with its inner diameter being dimensioned in such a way that it rests on the raised grooved structures 3. For the shaping of the workpiece 7, the shaping tool 2 rotates together with the workpiece 7 which is secured to it, and the pressing rollers 4, 5, 6, which are secured to a feeding carriage, not shown here, are subjected to a feeding displacement in the axial direction. The pressing rollers 4, 5, 6 are pressed radially against the workpiece 7, with the result that the latter is plastically deformed.

Figure 2:
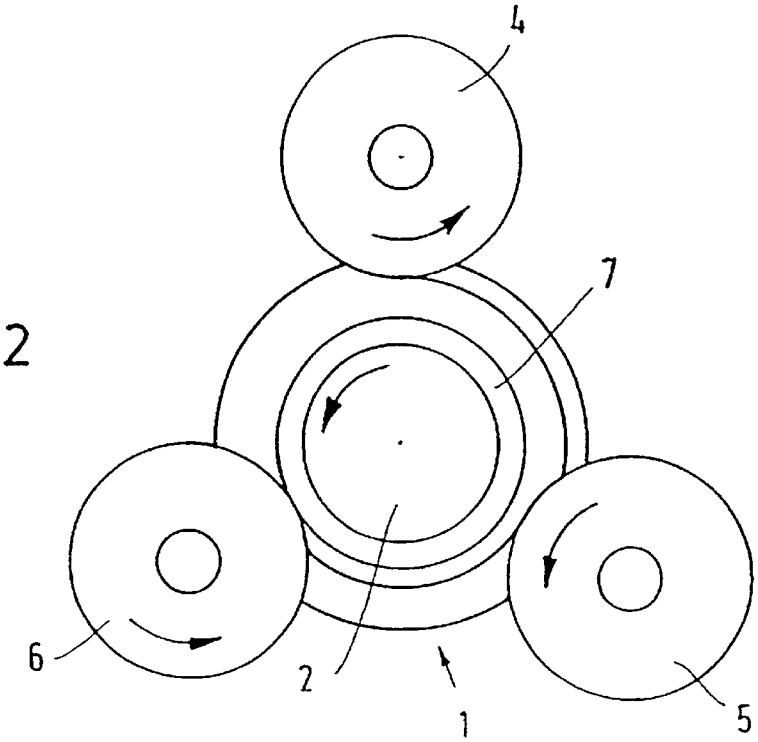
FIG. 2 shows a rear view according to the arrow II in FIG. 1.

In FIG. 1 the pressing rollers 4, 5, 6 are rotated in the drawing plane for a better representation. The actual arrangement is shown in FIG. 2. The three pressing rollers 4, 5, 6 are arranged equidistantly in terms of the circumference, i.e. between them there is a circumferential angle of 120° in each case.

The pressing rollers 4, 5, 6 are rotatably mounted, with the three pressing rollers 4, 5, 6 being driven in the same direction as the shaping tool 2 (in FIG. 2 in anticlockwise direction). This leads to the material of the workpiece 7, which has become plastic under the contact pressure, for example of the pressing roller 4, being slowed down to a certain extent between the pressing roller 4 and the shaping tool 2 and in this way being pressed better into the roller structure 3.

Figure 3:
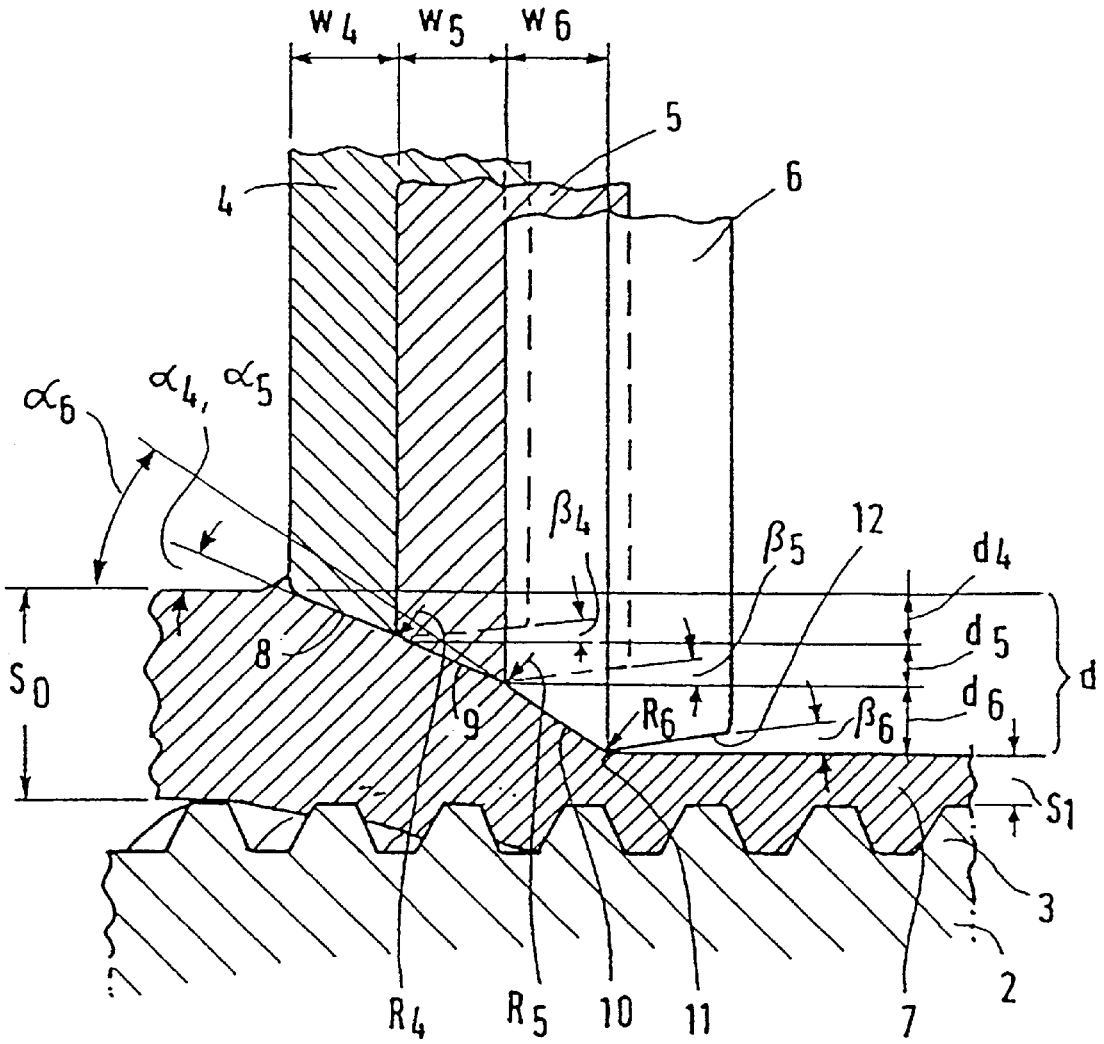
FIG. 3 shows a longitudinal section through the pressing roller device.

FIG. 3 shows the three pressing rollers 4, 5, 6 in the plane of the drawing in a better representation. In fact, the three pressing rollers 4, 5, 6 are actually staggered by 120° to each other in terms of the circumference. For a better representation, the offset w4, w5, w6 between the pressing rollers 4, 5, 6 is shown to be greater than it is in reality.

The first pressing roller 4 is the first one to come into contact with the workpiece 7. It abuts the workpiece 7 with a conical pressing surface 8. The wall thickness of the workpiece 7, proceeding by way of axial advancing movement from an original wall thickness $S_0$, is reduced by the first pressing roller 4 by the thickness $d_4$. In this respect, the first pressing roller 4 runs on helical paths over the surface of the workpiece 7. The advancing movement and the rotating speed with which the pressing roller 4 rotates the workpiece 7 are coordinated with each other in such a way that the pressing roller 4 covers the entire surface of the workpiece 7. The entry angle $\alpha_4$ of the first pressing roller 4 lies in an angle range of 5 to 30° and preferably amounts to 20°. The entry angle is the angle between the pressing surface 8 and the outer surface of the workpiece 7. The pressing surface 9 of the second pressing roller 5 has the same geometry. The pressing surface 10 of the third pressing roller 6 extends at an entry angle $\alpha_6$ which is larger than the entry angles $\alpha_4$, $\alpha_5$ of the first pressing rollers 4, 5. The entry angle $\alpha_6$ lies in the range of 10° to 40° and preferably amounts to 30°.

A transition region 11 continues from the pressing surface 10, the transition region passing over into an exit surface 12 of the pressing roller 6. The transition region 11 has a radius $R_6$ which corresponds approximately to the starting wall thickness $S_0$ plus half the end wall thickness $S_1$ of the workpiece 7 ($R_6=S_0+0.5\ S_1$). The first and second pressing rollers 4, 5 also have a respective transition region with the radii $R_4$ and $R_5$, with these radii corresponding to the radius $R_6$. The exit surfaces extend at an exit angle $\beta_4$, $\beta_5$,$\beta_6$ with respect to the outer wall of the workpiece 7. The exit angles $\beta$ of the pressing rollers 4, 5, 6 are of the same size and lie in angle range of 0° to 15°, preferably 3° to 5°.

The offset w4, w5, w6, that is to say the respective axial spacing between the pressing rollers 4, 5, 6, amounts to 0.1 to 5 mm in each case.

The pressing rollers 4, 5, 6 have a variable radial spacing from the shaping tool 2, or from the workpiece 7. The first pressing roller 4 has the largest spacing because it works on the workpiece 7 first. At the exit-side end of the pressing surface 8 of the first pressing roller 4, the original wall thickness $S_0$ of the workpiece 7 is reduced by the amount $d_4$. The input-side end of the pressing surface 9 of the second pressing roller 5 now engages in this radial spacing $S_0$-$d_4$. The wall thickness is reduced by the amount $d_5$ by means of the pressing surface 9 of the second pressing roller 5. The last pressing roller 6 reduces the wall thickness by the amount $d_6$ until the desired target wall thickness $S_1$ of the workpiece 7 is reached. The wall thickness of the workpiece 7 is therefore reduced from the original wall thickness $S_0$ to the target wall thickness $S_1$. The wall thickness reduction d is composed of the individual reductions $d_4$, $d_5$, $d_6$, with each individual reduction amounting to 0.2 to 0.4 times the total reduction d.

The shaping of the inner grooved structure also takes place in sections. At the beginning of the pressing roller operation the workpiece 7 rests on the raised grooved structure 3 of the shaping tool 2. The wall thickness $S_0$ of the workpiece 7 corresponds to the following formula:

$$S_0=2\times S_1+2.2\times m$$

with $S_1$ being the final wall thickness and m being the toothed module of the shaping tool 2 which corresponds to the flank clearance of two adjacent grooves divided by. The first pressing roller 4 presses the material of the workpiece 7 somewhat into the grooved structure 3 of the shaping tool 2. The pressing roller 5 presses the material further into the grooved structure 3, while the last pressing roller 6 fills the grooved structure 3 completely with the material of the workpiece 7 and sets the desired target wall thickness $S_1$.

What is claimed is:

1. A pressing roller device for molding a grooved structure into a tubular workpiece, the device comprising a tubular shaping tool having an externally grooved structure, at least three pressing rollers which rotate relative to the shaping tool and ARE spaced around a circumference of the tubular shaping tool, the at least three pressing rollers being axially displaceable in an advancing direction and driven in a rotating manner, the pressing rollers having conical pressing surfaces extending at a respective entry angle with the tubular workpiece, wherein the pressing surface of the last pressing roller have a larger entry angle than the pressing rollers forward of last pressing roller.

2. The pressing roller device according to clam 1, characterized in that the pressing surface of the last pressing roller has an entry angle of about 30° and the other pressing rollers having an entry angle of about 20° in each case.

3. The pressing roller device according to clam 1, characterized in that the pressing rollers are staggered slightly axially with respect to each other, with the distance between the pressing surfaces of the pressing rollers and the shaping tool increasing in the advancing direction.

4. The pressing roller device according to claim 3, characterized in that an axial spacing from a forward edge of one of the pressing rollers to a forward edge of an adjacent pressing roller amounts to 0.1 to 5 mm.

5. The pressing roller device according to claim 1, characterized in that each pressing roller has transition region between the pressing surface and an exit surface, a radius of the transition region corresponding to a starting wall thickness ($S_0$) plus half an end wall thickness ($S_1$) of the workpiece.

6. The pressing roller device according to claim 1, characterized in that a starting wall thickness $S_0$ of the workpiece corresponds to the following formula:

$$S_0=2\times S_1+2.2\times m$$

with $S_1$ being the material thickness over the grooved structure o the finished workpiece and m being the toothed module of the shaping tool.

7. The pressing roller device according to claim 1, characterized in that the pressing surface of the last pressing roller has an entry angle of 10–40° and the other pressing rollers have an entry angle of 5–30°.

8. A method for molding a grooved structure into a tubular workpiece with the use of a device which has at least three axially staggered pressing rollers rotating about a shaping tool and spaced around a circumference of the shaping tool, the method comprising:

attaching the workpiece, which has a starting wall thickness $S_0$ greater than a target wall thickness $S_1$, on to the shaping tool;

rotating the shaping tool;

advancing of the pressing rollers along the workpiece in an advancing direction, with the last pressing roller in the advancing direction having a pressing surface, the entry angle with the tubular workpiece of which is larger than the entry angles of the pressing rollers forward of the last processing roller.

* * * * *